United States Patent [19]

Nakamura et al.

[11] Patent Number: 4,933,699

[45] Date of Patent: Jun. 12, 1990

[54] RACK FOR PROCESSING PHOTOSENSITIVE MATERIAL

[75] Inventors: Takashi Nakamura; Hiroshi Matsuoka; Tetsuya Noritsuki, all of Kanagawa, Japan

[73] Assignee: Fuji Photo Film Co., Ltd., Kanagawa, Japan

[21] Appl. No.: 398,356

[22] Filed: Aug. 24, 1989

[30] Foreign Application Priority Data

Sep. 5, 1988 [JP] Japan ..... 63-220443
Sep. 5, 1988 [JP] Japan ..... 63-220444

[51] Int. Cl.[5] ..... G03D 3/13
[52] U.S. Cl. ..... 354/320; 354/321
[58] Field of Search ..... 354/320, 321, 322, 338, 354/339, 316, 331

[56] References Cited

U.S. PATENT DOCUMENTS 3,468,693 9/1969 Hanson ..... 354/320
3,495,520 2/1970 Schumacher ..... 354/321
4,079,635 3/1978 Hope et al. ..... 354/321
4,416,529 11/1983 Kastl ..... 354/320
4,521,092 6/1985 Ferrante ..... 354/320
4,833,496 5/1989 Hall ..... 354/338
4,853,728 8/1989 Hall ..... 354/320

*Primary Examiner*—A. A. Mathews
*Attorney, Agent, or Firm*—Sughrue, Mion, Zinn, Macpeak & Seas

[57] ABSTRACT

A rack for processing a photosensitive material includes a roller transport mechanism composed of a plurality of transport rollers for transporting the photosensitive material to dip the photosensitive material in a processing solution contained in a processing tank. The plurality of transport rollers includes two pairs of generally opposed rollers, the two pairs being disposed adjacent to each other along a path of transport of the photosensitive material. The rollers of each pair of rollers between which the photosensitive material passes is spaced from each other by a distance greater than the thickness of the photosensitive material. A shutter mechanism is provided for covering the surface of the processing solution. The shutter mechanism is disposed between the two pairs of rollers.

13 Claims, 3 Drawing Sheets

RACK FOR PROCESSING PHOTOSENSITIVE MATERIAL

BACKGROUND OF THE INVENTION

The present invention relates to a rack for processing a photosensitive material in which the photosensitive material, after being exposed to image light from an original document or photographic scene, is dipped in a processing solution so as to be processed.

Generally, in an automatic developing machine for processing with a silver halide-photosensitive material, the developing of the photosensitive material is carried out by transporting the photosensitive material through a developing tank to dip the photosensitive material for a predetermined time period in a developing solution contained in the developing tank.

After developing, the photosensitive material is subjected to treatments or processings such as bleaching, fixing and rinsing, according to the application at hand. In order that the photosensitive material can be efficiently transported through the tanks holding the various treatment or processing solutions so as to be dipped in these processing solutions, these processing tanks are arranged, for example, in parallel relation. Each of the processing tanks is elongated or longitudinally vertically oriented so that the photosensitive material is transported through each processing tank in a vertical direction. More specifically, the photosensitive material is first transported vertically downward in the developing solution in the developing tank, and then is turned upward at the bottom portion of the developing tank, and then is transported vertically upward. The photosensitive material emerging from the developing tank is transported to the next processing tank.

Since upon contact with the oxygen in the air the developing solution is oxidized and thus deteriorated, it is therefore necessary to avoid contact of the developing solution with the air.

There is known a roller transport mechanism for transporting a photosensitive material in which two rows of transport rollers are alternately arranged in a noncontacting manner on opposite sides of a transport path. The photosensitive material is held in contact with the peripheral surfaces of the transport rollers so as to be transported by friction therebetween. In such a transport mechanism, a liquid surface shutter for preventing oxidation of the developing solution cannot easily be provided since the transport rollers and other parts are disposed close to each other. Therefore, contact between the liquid surface and the air cannot be avoided.

SUMMARY OF THE INVENTION

With the above deficiencies of the prior art in view, it is an object of this invention to provide a rack in which a photosensitive material is transported by a roller transport mechanism in such a manner as to avoid contact between a processing solution and the air as much as possible.

This and other objects of the invention have been achieved by a rack for processing a photosensitive material, the rack being adapted to be mounted in a tank for holding a processing solution and comprising:

(a) a roller transport mechanism comprising a plurality of transport rollers for transporting the photosensitive material in such a manner as to dip the photosensitive material in the processing solution, the plurality of transport rollers having two pairs of generally opposed rollers, the two pairs being disposed adjacent to each other along a path of transport of the photosensitive material, and each pair of rollers being spaced from each other by distance greater than the thickness of the photosensitive material; and (b) shutter means for covering the surface of the processing solution, the shutter means being disposed between the two pairs of rollers.

DESCRIPTION OF THE PREFERRED EMBODIMENTS OF THE INVENTION

Figure 2:
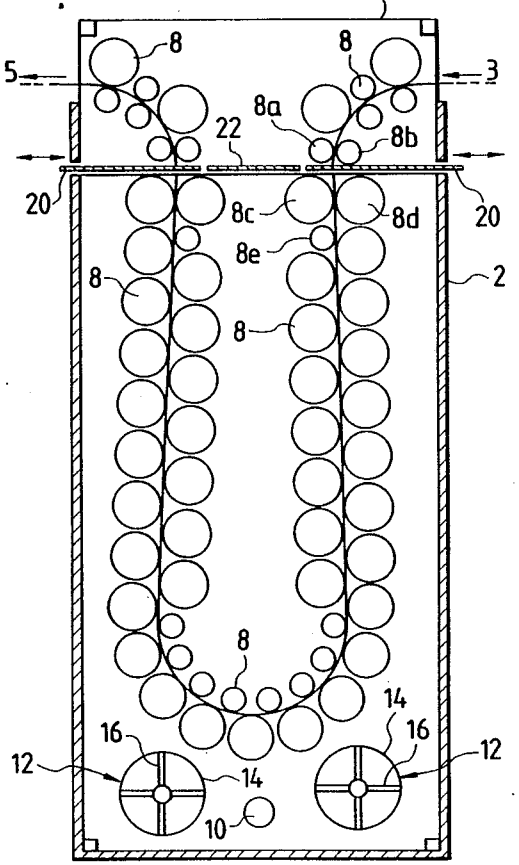
FIG. 2 is a schematic cross-sectional view of the developing tank.

A first preferred embodiment of the invention will now be described with reference to FIGS. 1 and 2.

In an automatic developing machine of the type mentioned above, all the processing tanks are of the same construction. The principles of the invention will be described using a developing tank holding a developing solution as an example.

Figure 1:
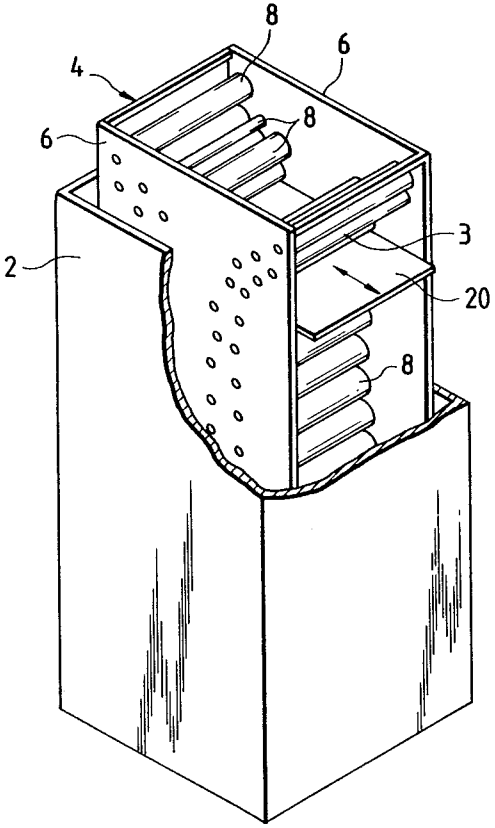
FIG. 1 is a partly broken schematic perspective view of a developing tank incorporating a rack provided in accordance with the present invention.

FIG. 1 is a partly broken schematic cross-sectional view of a developing tank 2 for developing a photosensitive material A.

A rack 4 is mounted in the tank 2 which holds a developing solution, the rack 4 guiding the movement of the photosensitive material A through the tank 2. The rack 4 has a rectangular body having a pair of opposed side walls 6. Two rows of transport rollers 8 for transporting the photosensitive material A extend between and are supported by the opposed side walls 6. As best shown in FIG. 2, the two rows of rollers 8 are arranged in a generally U-shape to form a roller transport mechanism.

One row of transport rollers 8 are disposed in alternate relation to the other row in such a manner that the peripheral surfaces of the transport rollers are disposed in contiguous relation to the path of transport of the photosensitive material A. As best shown in FIG. 2, the transport rollers 8 are not in contact with one another, but the two rows of transport rollers 8 are in contact with the opposite sides of the photosensitive material A so as to transport the photosensitive material A along the path of transport due to the friction between the rollers 8 and the photosensitive material A.

The individual rollers of each row of transport rollers 8 are connected by gears in such a manner that the peripheral surfaces of the rollers 8 can rotate at a constant speed. Therefore, the photosensitive material A can be transported by the two rows of transport rollers 8 without being loosened between the two rows.

A heater 10 and an agitating member 12 are mounted within the tank 2 at its bottom portion. The heater 10 serves to heat the developing solution within the tank 2 to the optimum temperature, and the agitating member 12 serves to agitate the developing solution. The agitating member 12 is formed by a disc 14 having fins 16 formed on the opposite sides or faces thereof, and the disc 14 is driven for rotation by a drive device (not shown) to thereby agitate the developing solution. As described above, since the two rows of transport rollers 8 constituting the roller transport mechanism are arranged in a U-shape within the tank 2, the photosensitive material A transported by the transport rollers 8 is first introduced into the tank 2 from an inlet 3, then moves vertically downward, and then is turned upward at the bottom portion of the tank 2, and then moves vertically upward, and finally is discharged from the tank 2 through an outlet 5.

The alternate arrangement of the transport rollers 8 is not maintained at those positions adjacent to the level of the developing solution (i.e., the liquid surface of the developing solution) near the inlet 3 and the outlet 5. At the inlet side, the transport rollers **8*a* and 8*b* are either accurately or generally opposed to each other and are disposed above the liquid level in either substantially or generally parallel relation thereto. Also, at the lower side of the liquid level, the transport rollers 8*c* and 8*d* are either accurately or generally opposed to each other in either substantially or generally parallel relation to the liquid level. Those transport rollers 8** disposed adjacent to the liquid level at the outlet side are also arranged in a similar manner.

The path of transport of the photosensitive material A is curved from the inlet 3 thereof and extends generally vertically downward through the liquid level or surface of the developing solution. Those transport rollers 8 disposed upstream of the pair of rollers **8*a* and 8*b*** on the opposite sides of the curved portion of the transport path have different diameters so as to be disposed in a staggered manner.

At the lower side of the liquid level, the path of transport of the photosensitive material A extends generally vertically downward, and the roller **8*e* of a smaller diameter is disposed between the pair of rollers 8*c* and 8*d* and those transport rollers 8 disposed downstream of them in an alternating, staggered manner so that the roller 8*e*** can prevent the photosensitive material A from being displaced from its transport path.

The spacing or distance between the pair of rollers **8*a* and 8*b* as well as a spacing between the pair of rollers 8*c* and 8*d*** is slightly greater than the thickness of the photosensitive material A, and it is preferred that this spacing be in a range of 1 to 3 mm.

The liquid level (surface) of the developing solution is disposed between the pair of rollers **8*a* and 8*b* and the pair of rollers 8*c* and 8*d*, and a movable shutter 20** is disposed between these two pairs slightly above the liquid level.

The movable shutter 20 may be implemented with one shutter member for closing the liquid surface at both of the inlet and outlet sides. Alternatively, as shown in the drawings, two movable shutters 20 may be used and disposed on respective opposite sides of a fixed shutter 22 so as to close the liquid surface separately at the inlet and outlet sides. When the movable shutters 20 are disposed in contact with the liquid surface, the developing solution deposits on the upper surfaces of the movable shutters 20 because of a surface tension a thereof. As a result, crystals of the developing solutions, etc., are formed on the movable shutters 20. This adversely affects the sealing ability, and when such crystals are again mixed with the developing solution, the developing solution is deteriorated. For these reasons, it is preferred that the movable shutters 20 be disposed close to the liquid surface but not in contact therewith.

When the movable shutters 20 are closed to seal the developing solution, the amount of air within the space between the surface of the developing solution and the shutters 20 and 22 is small, and fresh air will not contact the developing solution. Therefore, the deterioration of the developing solution due to oxidation can be restrained to a minimum. The movable shutters 20 can be moved as indicated by double-headed arrows in the drawing. Before introducing the photosensitive material A into the tank 2, the movable shutters 20 are moved to their open positions to open the path of transport of the photosensitive material A. Then, the photosensitive material A is dipped in the developing solution to effect the developing thereof, and after the photosensitive material A is discharged from the tank 2, the movable shutters 20 are moved to the closed positions to seal the developing solution. Thus, although during the developing of the photosensitive material A, the developing solution is in contact with the air through the openings opened by the movable shutters 20, the contact of the developing solution with the air can be reduced to a minimum when developing of the photosensitive material A is not being carried out.

When the pair of rollers **8*a* and 8*b* as well as the pair of rollers 8*c* and 8*d* are accurately opposed to each other, these pair of rollers only serve to guide the movement of the photosensitive material A and do not function to transport it. Therefore, it is preferred that each pair of opposed transport rollers be slightly displaced with respect to each other in a slightly staggered condition in such a manner that they will not interfere with the liquid surface and the movable shutters 20**, thus providing a slightly alternating arrangement having a staggered effect, although the staggered effect is rather incomplete.

A second preferred embodiment of the invention will now be described with reference to FIGS. 3 and 4.

Figure 3:
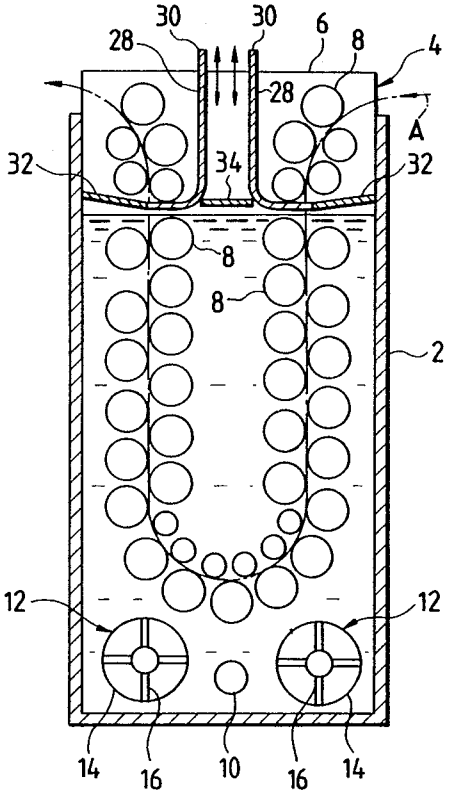
FIG. 3 is a view similar to FIG. 2 but showing a second preferred embodiment of the invention.

FIG. 3 is a schematic, cross-sectional view of a developing tank 2 for the photosensitive material A.

The photosensitive material A is transported by transport rollers 8 first moves vertically downward, and then is turned upward at the bottom portion of the tank 2, and then moved vertically upward. In a conventional roller transport mechanism, each transport roller in one row and the transport roller of the other row adjacent thereto are not spaced from each other in the direction of the transport path, and at least one of the transport rollers intersects the surface of the developing solution, and is in contact with both of the developing solution and the air. In contrast, in the roller transport mechanism of the present invention, a space is formed between the transport rollers 8 in such a manner that any transport roller 8 does not intersect the surface of the developing solution. The developing solution is charged into the tank 2 in such a manner that the liquid surface of the developing solution is disposed in this space.

Figure 4:
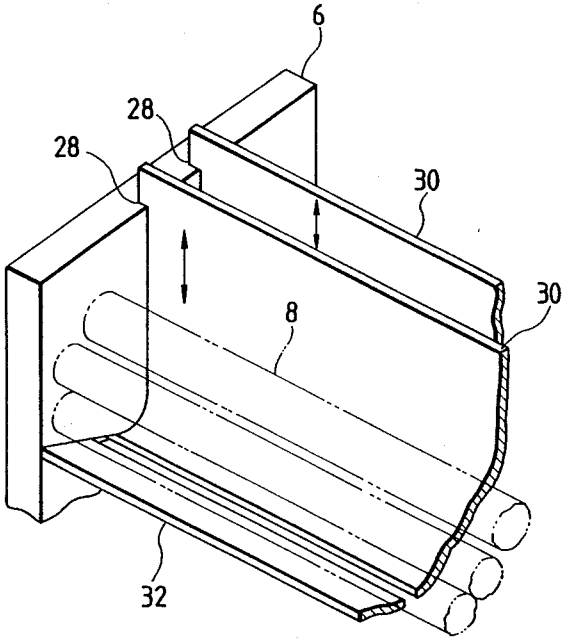
FIG. 4 is a fragmentary perspective view of a rack of FIG. 3.

FIG. 4 shows an upper portion of the rack 4 of FIG. 3. The opposed side walls 6 and 6 of the rack each comprise a sheet or plate of metal or a plastic material having a thickness of 10 mm. Two grooves 28 and 28 are formed in each side wall 6, and each groove 28 extends downward from the upper edge of the side wall 6 at its central portion, and is curved outward and extends generally horizontally in a plane of the space between the transport rollers 8. The lower or distal end of each groove 28 extends outward beyond the path of transport of the photosensitive material A.

Two flexible movable shutter 30 are received at their opposite edges in the two pairs of grooves 28 in the opposed side walls 6, the movable shutter 30 being in the form of a sheet made, for example, of an ABS resin or metal and being flexible so that the movable shutter 30 is movable along the pair of mating grooves 28.

A pair of fixed shutters 32 are disposed adjacent to the other two side walls of the rack, respectively. Each fixed shutter 32 extends generally horizontally from the end of the pair of mating grooves 28. Each movable shutter 30, movable along the pair of mating grooves 28, is abuttable against a respective one of the fixed shutters 32, thus limiting the movement of the movable shutter 30 by the fixed shutter 32. Each fixed shutter 32 is hermetically connected at its periphery to the inner surfaces of the tank 2.

Another fixed shutter 34 is mounted on the opposed side walls 6 so as to close the space between the two movable shutters 30. The fixed shutter 34 is disposed in sealing contact with the two movable shutters 30.

The movable shutters 30, the fixed shutters 32 and the fixed shutter 34 extend between the opposed side walls 6. The developing solution in the tank 2 is kept in a sealed condition by contact of the movable shutters 30 with the respective fixed shutters 32. Therefore, the developing solution is kept out of contact with the air and is not deteriorated by oxidation. When the movable shutters 30, the fixed shutters 32 and the fixed shutter 34 are disposed in contact with the developing solution, the developing solution, a fixing solution, etc., deposit on the upper surfaces of these shutters due to the surface tension thereof. As a result, crystals of such solution are produced on the shutters. This adversely affects the sealing ability. For these reasons, it is preferred that the movable shutters 30 and the fixed shutters 32 and 34 be disposed in closely spaced relation to the developing solution. In this case, a small amount of air is present in the space between the surface of the developing solution and the shutters 30, 32 and 34, and the developing solution is subjected to oxidation. However, after oxidation by this air, this air is saturated, and therefore further oxidation of the developing solution will not occur, and hence very little adverse effect on the developing solution will occur.

The movable shutters 30 can be moved as indicated by double headed-arrows. Before introducing the photosensitive material A into the tank 2, the two movable shutters 30 are pulled upward to be spaced from the respective fixed shutters 32 to thereby open the path of transport of the photosensitive material A at both of the inlet and outlet sides. Then, the photosensitive material A is introduced into the tank 2 and is dipped in the developing solution to carry out the developing. After the photosensitive material A is discharged from the tank 2, the movable shutters 30 are pushed downward into engagement with the respective fixed shutters 32. Thus, although during the developing of the photosensitive material A, the developing solution is in contact with the air through the spaces between the movable shutters 30 and the fixed shutters 32, the contact of the developing solution with air can be reduced to a minimum when developing of the photosensitive material A is not being effected.

Figure 5:
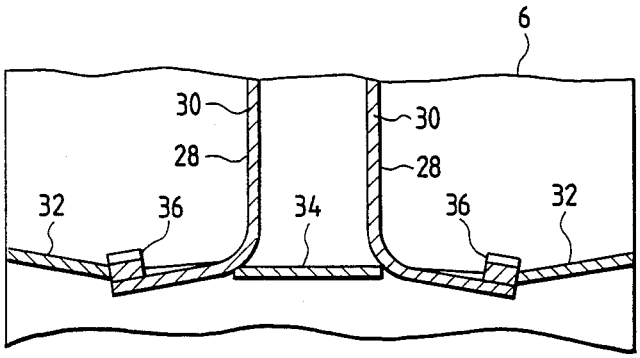
FIGS. 5 to 7 are fragmentary cross-sectional views showing modified movable shutters, respectively.

FIG. 5 shows a modified form of the invention. In this embodiment, a seal member 36 of a predetermined thickness is mounted on the upper surface of the lower or distal end of each movable shutter 30 in the direction of its width. If each movable shutter 30 is not fully abutted against its mating fixed shutter 32 when the movable shutter 30 closes or block the path of transport of the photosensitive material A, the developing solution is not sealed. The lower end of the movable shutter (particularly, the central portion of the lower end in the direction of the width) may bulge or bend downward due to its own weight. If such a case is encountered, the movable shutter 30 cannot be completely abutted against the fixed shutter 32 throughout the entire width thereof. As a result, even when the movable shutter 30 blocks the transport path, there exists a space between the movable shutter 30 and the fixed shutter 32, thus failing to seal the developing solution. Therefore, by providing the seal member 36 on the upper surface of the lower end of the movable shutter 30, the space between the movable shutter 30 and the fixed shutter 32 can be suitably closed by the seal member 36 even if the lower end of the movable shutter 30 bulges or bends downward, thus securing the sealing of the developing solution.

Figure 6:
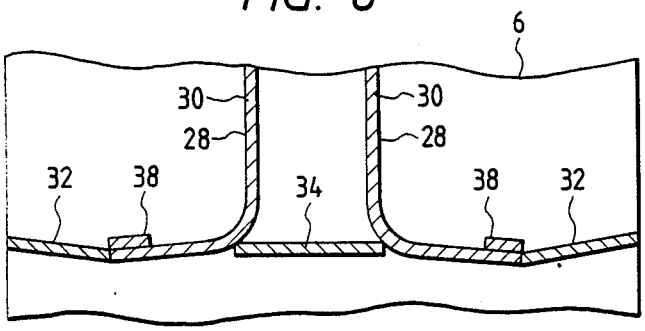

FIG. 6 shows another modified form of the invention. In this embodiment, a highly rigid member 38 is mounted on the upper surface of the lower end of each movable shutter 30 in the direction of its width. By virtue of the provision of the highly rigid member 38, the lower end of the movable shutter will not bulge or bend downward when the movable shutter 30 is abutted against the fixed shutter 32, thus preventing a space from developing therebetween.

Figure 7:
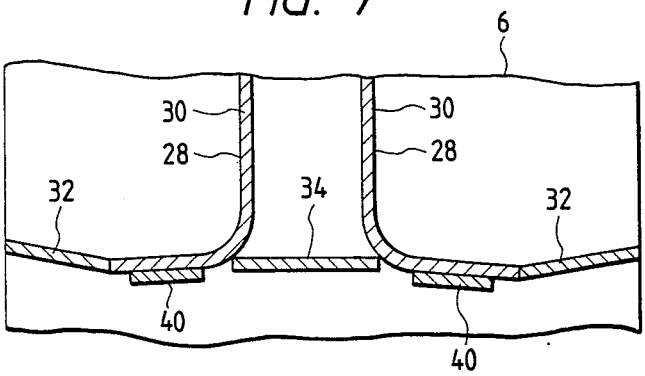

FIG. 7 shows a further modified form of the invention. In this embodiment, a support member 40 for supporting each movable shutter 30 is mounted adjacent to the position where each movable shutter 30 is abutted against its mating fixed shutter 32, each support member 40 extending between the opposed side walls 6. Due to the provision of the two support members 40, the two movable shutters 30 will not bulge downward when they are abutted against their mating fixed shutters 32, thus preventing a space from developing between the movable shutter 30 and the fixed shutter 32. Alternatively, the fixed shutter 34 may be modified so that the fixed shutter 34 can support the lower ends of the two movable shutters 30 when they are abutted against the respective fixed shutters 32.

The movable shutters 30 can be manually operated to be moved between their open and closed positions. Alternatively, the movable shutters 30 can be automatically driven to be moved by a suitable drive means, in which case the movable a shutters 30 can be opened in synchronism with the introduction of the photosensitive material A into the tank 2 and can be closed in synchronism with the discharge of the photosensitive material A from the tank 2.

For example, a sensor for detecting the photosensitive material A may be provided upstream of the movable shutter 30 on the inlet side, and this sensor is electrically connected to the drive device which operates the movable shutter. The sensor detects the leading edge of the photosensitive material A, and when the photosensitive material A reaches each movable shutter 30, the movable shutter is moved upward to open the transport path. Then, the sensor detects the trailing edge of the photosensitive material A, and then when the photosensitive material A passes each movable shutter 30, each movable shutter is moved downward to block or close the transport path. For example, the operations of the movable shutters 30 can be effected predetermined periods of time after the photosensitive material A is detected by the sensor.

Although in the above embodiments two movable shutters 30 are provided, the two movable shutters 30 may be formed as a unitary construction. For example, the two movable shutters 30 can be fixedly connected together at their opposed portions, in which case the two movable shutters 30 are moved together upward and downward.

Also, in the above embodiments, although the side walls 6 of the rack have a thickness of 10 mm, it will suffice that the side wall 6 has a thickness of not less than 3 mm to provide the grooves 28 for guiding the movement of the movable shutter 30.

As described above, in the rack for processing the photosensitive material provided in accordance with the present invention, the roller transport mechanism mounted in the rack includes the two pairs of accurately or generally opposed rollers disposed adjacent to each other. The movable shutters are provided between the two pairs of rollers above the surface of the processing solution or liquid, and the movable shutters can suitably open and close the path of transport of the photosensitive material. With this construction, when the photosensitive material is not being transported, the transport path is closed or blocked to seal the processing tank, thereby preventing contact of the processing solution with the air as much as possible. Therefore, deterioration of the processing solution can be delayed, and processing can be carried out in a stable manner over a long period of time.

In the second embodiment of the invention, grooves are formed in the opposed surfaces of the side walls of the rack, each groove extending vertically downward and further extending generally horizontally in a plane of the space between the transport rollers above the surface of the processing liquid or solution. Each of the flexible movable shutters is received at the opposite edges thereof in the grooves so as to be movable along the grooves between an upper open position and a lower closed position where the movable shutter extends beyond the path of travel of the photosensitive material in the space between the transport rollers and is in sealing contact with the fixed shutter. The movement of the movable shutter in its opening direction is limited by the fixed shutter.

With this construction, the path of transport of the photosensitive material is suitably opened and closed by moving the movable shutters along the grooves, thereby preventing contact of the processing solution with the air as much as possible. Therefore, adverse effects such as oxidation of the processing solution by air can be reduced, and the processing of the photosensitive material can be satisfactorily carried out for a long period of time.

The member of a predetermined thickness can be provided on the upper surface of the end portion of the movable shutter, which is engageable with the fixed shutter, in the direction of the width thereof. With this arrangement, even if the movable shutter is loosened at its sealed position to form a space between the movable shutter and the fixed shutter, the above member can suitably seal such a space.

Also, the highly rigid member can be provided on the end portion of the movable shutter, which is engageable with the fixed shutter, in the direction of the width thereof. With this arrangement, the end portion of the movable shutter is reinforced and therefore will not be loosened, thus preventing a space from developing between this end portion and the fixed shutter. Therefore, a positive seal between the two can be obtained.

Further, the support member for supporting the movable shutter can be provided beneath the position where the movable shutter is engaged with the fixed shutter. With this arrangement, the movable shutter is prevented from being loosened at its end portion, thus preventing a space from developing between the movable shutter and the fixed shutter. Therefore, a positive seal between the two can be achieved.

The photosensitive material can be of any type so long as it can be processed by dipping it in the processing solution. For example, the invention can be suitably applied to a construction in which a long photographic film or a long photographic printing paper is dipped in a developing solution to be developed. The invention can also be suitably applied to a construction in which photographic films or photographic printing papers cut into sheets of a predetermined length are dipped in a developing solution to be developed.

What is claimed is:

1. A rack for processing a photosensitive material, said rack being adapted to be mounted in a tank for holding a processing solution, said rack comprising:

(a) a roller transport mechanism comprising a plurality of transport rollers for transporting the photosensitive material to dip the photosensitive material in the processing solution, said plurality of transport rollers comprising two pairs of generally opposed and staggered rollers, said two pairs being disposed adjacent to each other along a path of transport of the photosensitive material, and each said pair of rollers between which the photosensitive material passes being spaced from each other by a distance greater than the thickness of the photosensitive material; and (b) shutter means for covering the surface of the processing solution, said shutter means being disposed between said two pairs of rollers.

2. The rack according to claim 1, in which the surface of the processing solution is adapted to be disposed in the space between said two pairs of rollers slightly below said shutter means.

3. The rack according to claim 1, in which said shutter means comprises a movable shutter comprising one plate.

4. The rack according to claim 1, in which said shutter means comprises two movable shutters each comprising a plate, and a fixed shutter disposed between said two movable shutters.

5. The rack according to claim 1, in which said rack has a pair of opposed side walls having grooves formed in the opposed surfaces thereof, each of said grooves extending vertically downward from the upper edge of said side wall and further extending generally horizontally in a plane of a space between said two pair of rollers above the surface of the processing solution; said shutter means comprising a fixed shutter fixed to said side walls, and a flexible movable shutter received at its opposite edges in said grooves so as to be movable along said grooves between an upper open position and a lower closed position where said movable shutter extends beyond the path of travel of the photosensitive material in the space between said two pairs of rollers and is in sealing contact with said fixed shutter, and the movement of said movable shutter in its opening direction being limited by said fixed shutter.

6. The rack according to claim 5, in which a member of a predetermined thickness is mounted on an upper surface of an end portion of said movable shutter which is engageable with said fixed member, extending in a direction of width of said movable shutter.

7. The rack according to claim 5 or claim 6, further comprising a highly rigid member mounted on an end portion of said movable shutter, said highly rigid member being engageable with said fixed shutter and extending in a direction of width of said movable shutter.

8. The rack according to any one of claims 5 or 6, further comprising a support member for supporting said movable shutter mounted at a position beneath said closed position where said movable shutter is engaged with said fixed shutter.

9. The rack according to claim 1, in which said generally opposed and staggered rollers are slightly displaced with respect to each other in a slightly staggered condition.

10. A rack for processing a photosensitive material, said rack being adapted to be mounted in a tank for holding a processing solution, said rack comprising:

(a) a roller transport mechanism comprising a plurality of transport rollers extending between opposed side walls of said rack, said plurality of rollers being arranged in a generally U-shape, said plurality of rollers introducing the photosensitive material into the processing solution from above to dip the photosensitive material in the processing solution, and turning said photosensitive material at a bottom portion of said tank, and further transporting said photosensitive material upward, said plurality of transport rollers being vertically spaced from each other at a portion thereof to provide a space; said opposed side walls having grooves formed in the opposed surfaces thereof, each of said grooves extending vertically downward from upper edge of said side wall and further extending generally horizontally in a plane of said space between said transport rollers above the surface of the processing solution;

(b) said shutter means comprising a fixed shutter fixed to said side walls, and a flexible movable shutter received at its opposite edges in said grooves so as to be movable along said grooves between an upper open position and a lower closed position where said movable shutter extends beyond the path of travel of the photosensitive material in said space between said transport rollers and is in sealing contact with said fixed shutter, movement of said movable shutter in an opening direction thereof being limited by said fixed shutter.

11. The rack according to claim 10, further comprising a member of a predetermined thickness mounted on an upper surface of an end portion of said movable shutter, said member being engageable with said fixed member and extending in a direction of width of said movable shutter.

12. The rack according to claim 10 or claim 11, further comprising a highly rigid member mounted on an end portion of said movable shutter, said highly rigid member being engageable with said fixed shutter and extending in a direction of width of said movable shutter.

13. The rack according to any one of claims 10 to 11, further comprising a support member for supporting said movable shutter mounted at a position beneath said closed position where said movable shutter is engaged with said fixed shutter.

* * * * *